US009956789B2

(12) United States Patent
Moore et al.

(10) Patent No.: US 9,956,789 B2
(45) Date of Patent: May 1, 2018

(54) SYSTEMS AND METHODS FOR IMPLEMENTING A POST-PROCESSING SCHEME FOR MINIMIZING CURL IN SETS OF OUTPUT IMAGE RECEIVING MEDIA SUBSTRATES IMAGED IN IMAGE FORMING DEVICES

(71) Applicant: XEROX Corporation, Norwalk, CT (US)

(72) Inventors: Steven R Moore, Pittsford, NY (US); Paul J McConville, Webster, NY (US); Peter Michael Gulvin, Webster, NY (US); Jason M. LeFevre, Penfield, NY (US); David A. VanKouwenberg, Avon, NY (US); Andrew W. Hays, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 342 days.

(21) Appl. No.: 14/877,924

(22) Filed: Oct. 7, 2015

(65) Prior Publication Data

US 2017/0100943 A1 Apr. 13, 2017

(51) Int. Cl.

| | |
|---|---|
| ***B41J 11/00*** | (2006.01) |
| ***D21H 19/14*** | (2006.01) |
| ***D21H 23/30*** | (2006.01) |

(52) U.S. Cl.

CPC ..... *B41J 11/0015* (2013.01); *D21H 19/14* (2013.01); *D21H 23/30* (2013.01)

(58) Field of Classification Search

None

See application file for complete search history.

(56) References Cited

U.S. PATENT DOCUMENTS

| | | | | |
|---|---|---|---|---|
| 5,764,263 | A | 6/1998 | Lin | |
| 2003/0218650 | A1* | 11/2003 | Valero | B41J 2/16585 347/19 |
| 2011/0222126 | A1* | 9/2011 | Asai | B41J 2/2114 358/3.06 |

* cited by examiner

*Primary Examiner* — Lisa M Solomon

(74) *Attorney, Agent, or Firm* — Caesar Rivise, PC

(57) ABSTRACT

A system and method are provided for controlling archival sheet curl formation in image receiving media substrates on which images are formed using aqueous inks as the marking material. Archival curl occurs over time and is based on a partial coverage of the image receiving media substrates by the deposited water-based marking materials. A unique post-processing scheme applies selective aqueous clear fluid onto imaged substrates (cut sheets) to substantially counteract long-term archival curl formation in the individual image receiving media substrates. Both opposing sides of the cut sheet are processed in a manner that causes them to substantially equally undergo the generally irreversible shrinkage phenomenon that leads to archival curl, thus substantially canceling out the archival curl formation mechanism. A clear fluid is applied image-wise to portions of one or both sides of the image receiving media substrates to counterbalance the formed aqueous ink image.

21 Claims, 3 Drawing Sheets

SYSTEMS AND METHODS FOR IMPLEMENTING A POST-PROCESSING SCHEME FOR MINIMIZING CURL IN SETS OF OUTPUT IMAGE RECEIVING MEDIA SUBSTRATES IMAGED IN IMAGE FORMING DEVICES

BACKGROUND

1. Field of the Disclosed Embodiments

This disclosure relates to systems and methods for controlling archival sheet curl formation in image receiving media substrates on which images are formed, and particularly on which images are formed using aqueous inks as the marking material for marking the image receiving media substrates, the archival curl occurring over time and being based on a partial coverage of the image receiving media substrates by the deposited marking materials.

2. Related Art

Many modern image forming devices conduct increasingly sophisticated image forming operations, including multi-page "print jobs," for the production of finished (output) documents. These finished (output) documents often include increasing numbers of individual pages with black-and-white and color images formed on a broad spectrum of compositions of image receiving media substrates. These image forming operations particularly employ many different types of marking materials, and equally as many, if not more, compositions of image receiving media substrates to develop a particularly customized look that a user or user entity desires in its finished output documents.

In an image forming device, employing a specific marking material, which is often more difficult, if not impossible, to vary in the image forming device, a user may choose to experiment with increasingly wider latitudes in the selection of the compositions of the image receiving media substrates upon which the particular marking material are deposited to form the images. Image forming device manufacturers and suppliers often test their devices for use on a broad spectrum of compositions of image receiving media substrates. A result of such testing may lead to a series of recommendations for a user of the image forming device under test regarding "preferred" and/or "non-preferred" compositions of image receiving media substrates upon which images may be formed in the image forming device. As competition for market share among image forming device manufacturers and suppliers increases, a particular image forming device manufacturer generally seeks to limit specifying too many "non-preferred" options.

Nonetheless, the desire for wider substrate latitude can, in instances, raise difficulties in the details of the image forming operations and in downstream processing (and finishing) operations with regard to the image receiving media substrates on which images are formed. These difficulties manifest themselves in reductions in image quality, post-processing errors/failures, substrate handling and overall aesthetics of the finished (output) multi-page print job documents. When a difficulty is observed or uncovered, designers and manufacturers of the image forming device that exhibits the difficulty may seek or propose "fixes" in post-processing operations that are directed at effectively mitigating, or even eliminating, the exhibited difficulty.

Certain image forming devices use aqueous ink jet technologies to print (or form) images on image receiving media substrates. The aqueous inks, as the name implies, are water based. In these inks, the primary ink constituent component (often referred to as the "carrier") is the water component that carries the pigment material dispersed in solution in the water. In order to balance the deposition of the pigment with other physical effects that occur in the jetted ink image forming process, certain other additives are provided in the constitutions of the aqueous inks. Often for example, humectant substances are added. Humectants are a class of hygroscopic substances that are generally employed to keep things moist in a manner that is the functional opposite of desiccants. Humectants attract and retain moisture and are included in the aqueous inks, typically in a form of a glycerol or a glycol constituent component, to prevent the aqueous ink compositions from, for example, drying out too rapidly in the nozzles of the jetted ink delivery print heads. This formulation of constituent elements to make up a particular aqueous ink combines to cause the aqueous ink to be not only constituted primarily of water, but also to include additives that have a tendency to attract and retain additional moisture in the operating environments in which these aqueous inks are employed, and on the image receiving media substrates on which the aqueous inks are deposited for image forming. It is for this reason that aqueous inks are generally considered compatible with certain coated image receiving media substrates and less compatible for non-coated image receiving media substrates.

SUMMARY OF THE DISCLOSED EMBODIMENTS

In an effort to broaden the latitude of image receiving media substrates available for use in aqueous inkjet printing technologies, testing was undertaken to determine compatibility of certain aqueous ink compositions with uncoated cut sheets as the image receiving media substrates of choice. One observation that was made during this print testing was that the uncoated cut sheets tended develop undesirable curl artifacts. This undesirable curl may lead to difficulties in downstream image receiving media handling, particularly in instances when the undesirable curl is uneven among differing substrates. Post-processing of multi-page print jobs could be adversely affected by the presence of this undesirable curl.

It would be advantageous, in view of the above-identified shortfalls, to provide systems and methods that may be particularly usable to address, to an extent possible, formation of an undesirable curl artifact in an image forming device that forms images using aqueous inks as the marking material deposited on image receiving media substrates (cut sheets).

It would be further advantageous to provide a substrate de-curling capacity that may be able to be retrofit in operating scenarios in which current aqueous jetted ink systems are employed for image forming.

Exemplary embodiments of the systems and methods according to this disclosure may implement a post-processing scheme that applies selective aqueous clear fluid onto imaged substrates (cut sheets) to substantially counteract long-term curl formation in the individual image receiving media substrates. This long-term curl will be generally referred to throughout this disclosure as "archival" curl.

Exemplary embodiments may provide clear fluid to wet the imaged cut sheet on a side of the sheet opposite the side of the sheet on which the image content is formed.

Exemplary embodiments may cause both opposing sides of the cut sheet to substantially equally undergo the generally irreversible shrinkage phenomenon that leads to archival curl, thus substantially canceling out the archival curl formation mechanism.

Exemplary embodiments may scan a formed image on one or both sides of an image receiving media substrate and determine areas on the one or both sides that may be subject to promoting archival curl formation in the image receiving media substrate.

Exemplary embodiments may then apply a clear fluid to a determined portion on one or both sides of the image receiving media substrate substantially in a manner that is intended to effectively counterbalance the formed (aqueous ink) image.

In embodiments, the clear fluid could be water only, a water/humectant mix, or an ink vehicle minus (devoid of) the colorant or pigment suspended in solution.

Exemplary embodiments may deposit the clear fluid on a back (non-image) side of an image receiving media substrate of imaged regions that may exceed a threshold of aqueous ink mass. In embodiments, for duplex printing, the fluid may need to be applied to both sides of the sheet of image receiving media substrate.

Exemplary embodiments may apply the clear fluid image-wise, as opposed, for example, as a flood coat, with an objective of avoiding an imbalance that may result in net archival curl away from the image.

Exemplary embodiments may acceptably apply the clear fluid within approximately 5 mm with respect to the formed image.

Exemplary embodiments may meter an amount of clear fluid deposited to ensure that the amount is sufficient to fully wet constituent fibers on a back side of the image area.

In embodiments, the disclosed schemes, processes, techniques and methods may employ a principle of backside wetting in a post-processing step or as a function implemented in a post-processing apparatus. In embodiments, an implementing post-processor module may be located "near-line" or "off-line" from the image forming device or printing system (as those terms are understood by those of skill in the art.

In embodiments, a post-processor module may accept printed stacks of image receiving media substrates (sheets), apply clear fluid to counteract developing archival curl, and deliver the curl-stabilized stacks to an output component.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for controlling archival sheet curl formation in image receiving media substrates on which images are formed, and particularly on which images are formed using aqueous inks as the marking material for marking the image receiving media substrates, the archival curl being based on a partial coverage of the image receiving media substrates by the deposited marking materials, will be described, in detail, with reference to the following drawings, in which.

DETAILED DESCRIPTION OF THE DISCLOSED EMBODIMENTS

Figure 1:
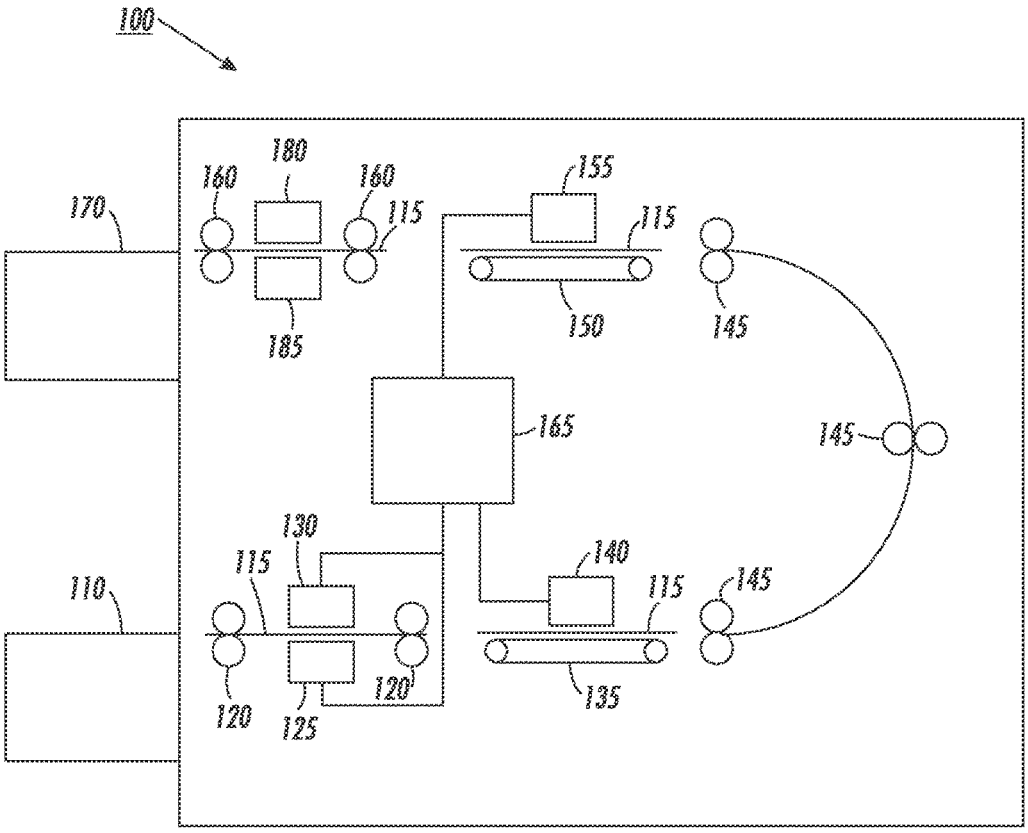
FIG. 1 illustrates a schematic diagram of an exemplary post-processing module for depositing clear fluid in an image-wise manner onto one or more sides of a sheet of image receiving media to reduce an archival curl artifact according to this disclosure.

The systems and methods for controlling sheet archival curl formation in image receiving media substrates on which images are formed, and particularly on which images are formed using aqueous inks as the marking material for marking the image receiving media substrates, the archival curl being based on a partial coverage of the image receiving media substrates by the deposited marking materials, will generally refer to this specific utility for those systems and methods. Exemplary embodiments described and depicted in this disclosure should not be interpreted (1) as being specifically limited to any particular configuration of an image forming device, a post-processing device or any individual module or component associated with an image forming device or post-processing device, or (2) as being directed to any particular limiting intended use. In fact, any specific manner by which to effect de-curling, or inhibiting curl formation, of image receiving media substrates in a particular system, component, configuration or technique that may benefit from the systems and methods according to this disclosure is contemplated.

Specific reference to, for example, any particular image forming device, should be understood as being exemplary only, and not limited, in any manner, to any particular class of such devices. Any commonly-known image forming system, particularly one that employs aqueous inks, as that term is commonly understood to those of skill in the art, as the marking material or medium for producing images on varying image receiving media substrates, which may employ post-processing that may be adapted according to the specific capabilities discussed in this disclosure, is contemplated.

The undesirable archival curl to which the systems and methods according to this disclosure may be directed is generally most prominently encountered when printing is undertaken using comparatively higher densities for the aqueous ink, and particularly manifests itself nearer to the edge portions of the sheet of image receiving media. Extensive testing revealed what appeared to be two distinct curl forming mechanisms. The first of the two distinct curl forming mechanisms is an almost immediate curl formation in a direction away from a single imaged side of the image receiving media substrate. The second of the two distinct curl forming mechanisms appears to manifest itself as a longer-term, or "permanent," curl back toward the imaged side of the single image receiving media substrate. Undesirable curl formed according to this second of the two distinct curl forming mechanisms may develop over a longer period, including over the course of several days. This longer-term curl is the undesirable archival curl to which the systems and methods according to this disclosure are directed.

In a bit more detail, the first curl mechanism is generally understood to be caused by one-sided wetting of the sheet of image receiving media. This one-sided wetting may cause reversible paper fiber expansion of the image deposition side of the sheet of the image receiving media. This paper fiber expansion primarily affects a diameter of the fiber itself rather than being manifested along a length of the fiber. This curl curvature will generally be about an axis parallel to the grain of the paper fiber. This immediate curl formation may be generally transient and, at some point, the sheet of image receiving media may re-flatten as the fiber expansion eases, often generally within minutes, as the moisture content of the sheet of image receiving media re-equilibrates with the environment.

The archival curl mechanism, though observed, is not as easily understood or characterized. One hypothesis is that the archival curl is triggered in circumstances where sufficient aqueous ink is deposited to fully wet the image deposition side of the sheet of image receiving media. It is generally known that fully wetted paper fibers may substantially release internal strain that was induced in the paper fibers in the papermaking process. Those of skill in the art may generally recognize that net shrinkage of 0.3-1.23% in a cross-grain axis occurs in the actual papermaking process. These thus-shrunk fibers may initially expand when wetted. As the fibers then dry out, the now-expanded fibers may then contract with a net irreversible shrinkage. Thus, when one side of a sheet of image receiving media is fully wetted by the water in the aqueous ink, the sheet will initially curl away from the wetted side, but then over an extended period of time the sheet will develop a permanent curl toward the wetted side.

It is observed that this archival curl behavior only occurs when sufficient water (as the component of the aqueous ink) is deposited to fully wet the one (image bearing) side, but not on the other side of the sheet of image receiving media. If too little water (as the component of the aqueous ink) is deposited to the one side of the sheet of image receiving media, the paper fibers in the sheet are not fully wetted. Likely, in these instances, no irreversible internal strain (shrinkage) is released. If too much water (as the component of the aqueous ink) is deposited to the one side of the sheet of image receiving media, both sides of the sheet of image receiving media may have the paper fibers fully wetted. This over-wetting condition may cause other difficulties in the image forming process, but the over-wetting, which may result in a net overall dimensional shrinkage, may not precipitate archival curl in the sheet of image receiving media.

Observing this phenomenon, the formation and existence of the undesirable archival curl may be viewed as a direct consequence of this aqueous inkjet image forming process in which top-most surface fibers of the uncoated sheets of image receiving media become fully wetted by the aqueous ink composition. It is likely that the physical interaction that is triggered is generally an irreversible shrinkage of these fibers over an extended period time, which results in the archival curl. It has been further observed that, depending on an overall landscape of aqueous ink coverage forming the images on the sheets of image receiving media substrate, undesirable archival curl may manifest itself so severely as to cause actual scrolling of the individual sheets of image receiving media. Conventionally, no identified print process parameter or print processing technique has been found that adequately addresses, much less mitigates or substantially eliminates this undesirable archival curl formation, except for equally undesirably limiting the overall aqueous ink area coverage on the image receiving media substrate.

For completeness, it should be noted that a number of other curl mitigating mechanisms were experimented with in an effort to understand what print process factors influence the magnitude of archival curl. The following factors, in experimental testing, were found to have insignificant effect on the formation of the undesirable archival curl addressed by the disclosed schemes:

- In-line decurling
- In-line drying
- Sheet tension during printing (over test range of 1-3 pli)
- Wire side vs. felt side printing
- Media type (across range of plain and ink jet treated media tested)
- Ink formulations (over the range of inks tested)

Conversely, the following factors were have found to have a significant effect on the formation of the archival curl:

- Number of ink layers in the formed image
- Image location on this sheet of image receiving media
- Paper grain direction
- Post-print sheet environment (see below)

It has been noted that sheets develop more archival curl when allowed to equilibrate to an office environment (70° F./50% RH) than when exposed to varied environmental combinations such as, for example, 70° F./10% RH or 80° F./80% RH. In very dry environments, the non-wetted side fibers may reversibly contract, causing less net curvature. In very moist environments, the sheet moisture content may stay elevated, which inhibits the irreversible shrinkage. These observed conditions do not lend themselves to a practical solution to archival curl, however. It should be recognized that certain of these factors are outside of the control of the device manufacturer or supplier since they are driven by user (customer) images, media selection, and an environment in which the image forming device is operated.

Additional testing looked at the effect of applying some manner of post-printing sheet constraint during the extended period in which undesirable archival curl may form. Because the typical output for a cut sheet printer will be sheet stacks, the effect of archival curl on stack quality was evaluated. One test evaluated 500 sheet stacks with varying weight constraints applied on top. It was determined that post-printing sheet constraint may mitigate archival curl, albeit that it may be difficult to practically put this solution into any substantial effect.

Against the above backdrop of incomplete or imperfect solutions, the disclosed schemes for backside or other supplemental wetting emerged, through rigorous experimentation, as an effective approach that may mitigate the formation of archival curl in cut sheets on which images are formed using aqueous inks. The operative principle prevalent in the disclosed schemes is to cause the paper fibers on the non-image side, or outside an image area, to undergo a substantially same net shrinkage as the image side fibers. In testing, an effectiveness of the disclosed schemes was demonstrated in which duplex prints were made with the same image content on each side of sheets of image receiving media. High ink mass on side one of the substrates was substantially counterbalanced by the same high ink mass on side two. Sheets of image receiving media with mirror images formed in this manner were observed to remain flat over time. Understandably, this technique does not present a practical solution to the difficulties presented by archival curl for myriad obvious reasons. Additional bench tests demonstrated that simply applying water as the backside counterbalancing fluid may prove effective.

The disclosed embodiments may advantageously configure a post-processing device (or post-processor) to apply a clear fluid to each sheet of image receiving media in order to counterbalance the effects of the inked image that may lead to the formation of archival curl. The clear fluid could be water only, a water/humectant mix, or an ink vehicle minus the pigment/colorant. The clear fluid may be deposited on a backside of imaged regions that exceed a threshold of a deposited aqueous ink mass. In general, for duplex printing, the clear fluid may be selectively applied to particular portions of both sides of the sheet of image receiving media on which the duplex images are formed. The clear fluid may be selectively applied in an image-wise manner, as opposed to flood coating the image receiving media substrate. The image-wise application of clear fluid is intended to counterbalance the curl-inducing nature of the image in a manner that may avoid creating an imbalance that could result in net archival curl away from the image.

A precise placement of the clear fluid may not be critical. For example, alignment of a bottom-side image-wise coating of a clear fluid within as much as a 5 mm offset with respect to a top-side image along any edge portion(s) of the top-side image may be sufficient to counterbalance the effects of the top-side image in a manner that restricts the archival curl formation. Also, the precise amounts of clear fluid deposited may not be critical as long as the deposited amounts of the clear fluid are sufficient to fully wet the fibers on the backside of the image area of the image receiving media substrate.

U.S. Pat. No. 5,764,263 to Lin describes a specifically different in-line application of a clear fluid onto sheets of image receiving media in a duplex inkjet printer that may have an effect of mitigating the formation of archival curl. The wetting schemes according to this disclosure advantageously employ the principle of backside wetting in a manner that differs from the 263 patent by requiring that the disclosed systems and methods are carried out in a separate post-processing device or post-processor module that may be located near-line or off-line from the image forming device or system that produces the inked images. The disclosed post-processing device may be configured to accept stacks of image-formed (printed) image receiving media substrates, to selectively apply clear fluid to the individual sheets of image-formed (printed) image receiving media to counteract the formation of archival curl in those sheets, and to deliver stabilized stacks of image-formed (printed) image receiving media substrates to an output of the post-processing device.

There are several unique advantages to requiring that the disclosed schemes be undertaken with an off-line post processing device, as opposed to being conducted in an in-line scheme. First, the base image forming system or device is not burdened with the incremental cost, footprint, and complexity necessary to provide an in-line backside wetting capability. In particular use scenarios in which users may routinely print transactional documents with low ink coverage for the images formed on the image receiving media substrates, the disclosed schemes for backside wetting may be wholly unnecessary. For users whose image forming needs would benefit from the disclosed schemes for backside wetting to mitigate archival curl formation, an off-line post-processing device may be separately offered. Second, in-line application of a clear fluid may necessarily increase the demands on other downstream processing components such as, for example, in-line drying assemblies by adding more moisture content to the printed sheets of image receiving media that needs to be dissipated in the drying process. Because much of the added water is absorbed by the sheet, and is not evaporated by the drying components, then the sheet moisture content can become too high for reliable in-line media handling and finishing in the image forming device itself. Third, in-line image-wise jetting of a clear fluid may interact with the other inks to change certain image quality parameters in instances in which the clear fluid is applied onto just-printed (and still relatively wet) inked images. Fourth, and as indicated above, testing has shown that requirements on drop size and drop placement accuracy for the clear fluid may be significantly less rigorous than for the printing of the images on the sheets of image receiving media. The clear fluid jetting process may, therefore, be conducted with print heads that are jetting the clear fluid at higher rates than would be allowable for image printing. The configuration of the disclosed off-line post-processing device may be optimized to capitalize on this speed improvement. Finally, an in-line approach is built into and, therefore, dedicated to a single printer. In a multi-printer office environment, the disclosed off-line post-processing device could be shared across multiple printers.

FIG. 1 illustrates a schematic diagram of an exemplary post-processor module (or post-processing device) 100 for depositing clear fluid in an image-wise manner onto one or more sides of individual sheets of image receiving media to reduce an archival curl artifact according to this disclosure.

As shown in FIG. 1, the exemplary post-processor module 100 may include an input (tray) component 110 that is configured to accept a stack consisting of a plurality of sheets of image-formed (printed) image receiving media, which may be, for example, physically transported from an output of an image forming device as one or more print jobs. The exemplary post-processor module 100 may also include an output (tray) component 170 that is configured to accept and stack the plurality of sheets of image-formed (printed) image receiving media after the post-processing as one or more stabilized print jobs.

The exemplary post-processor module 100 may be configured with a number of pairs of guide rollers 120,145,160, or other comparable guide components, that may be arranged in a manner to provide a directed sheet transport path for individual sheets of image receiving media 115 through the exemplary post-processor module 100. No particularly-limiting configuration to the sheet transport path, or to the series of components arranged to effect sheet transport through the post-processor module 100 is implied by the exemplary configuration shown in FIG. 1.

The exemplary post-processor module 100 may include image scanning components 125,130 that are arranged to scan images formed on one or both sides of each individual sheet of image receiving media 115 passing through the exemplary post-processor module 100 to determine a constitution of those images. The image scanning components 125,130 may comprise full-width array (FWA) scanner assemblies that read (or confirm) a placement and/or constitution of images formed on either or both sides of the individual sheets of image receiving media 115. Signals representing the placement and/or constitution of the images scanned by the image scanning components 125,130 may be transmitted to the controller 165 for processing.

The exemplary post-processor module 100 may include a plurality of clear fluid printing units. A first side clear fluid printing unit may include a first printing unit transport component 135, which may include a vacuum or electrostatic belt sheet holding unit, and a first side clear fluid printing device 140. A second side clear fluid printing unit may include a second printing unit transport component 150, which may also include a vacuum or electrostatic belt sheet holding unit, and a second side clear fluid printing device 155. The directed sheet transport path for the individual sheets of image receiving media between the first and second side clear fluid printing units in the exemplary post-processor module 100 may be configured in a manner that "inverts" the individual sheets of image receiving media to present the opposite sides of the sheets to the individual first and second side clear fluid printing devices 140,155. The individual first and second side clear fluid printing devices 140,155 may comprise FWA print heads that deposit the clear fluid in an image-wise manner onto each side of the sheet of image receiving media under control of the controller 165.

Once the individual sheets of image receiving media 115 are clear fluid "printed" or treated, the treated side(s) of the sheets of image receiving media may be dried by some manner of in-line sheet surface drying component(s) 180, 185. Whether additionally dried or not, the treated sheets of image receiving media may then be re-stacked in the output (tray) component 170 of the post-processor module 100. The controller 165 may coordinate all of the details in the operation of each of the components in the exemplary post-processor module 100 in implementing the disclosed clear fluid wetting process.

Figure 2:
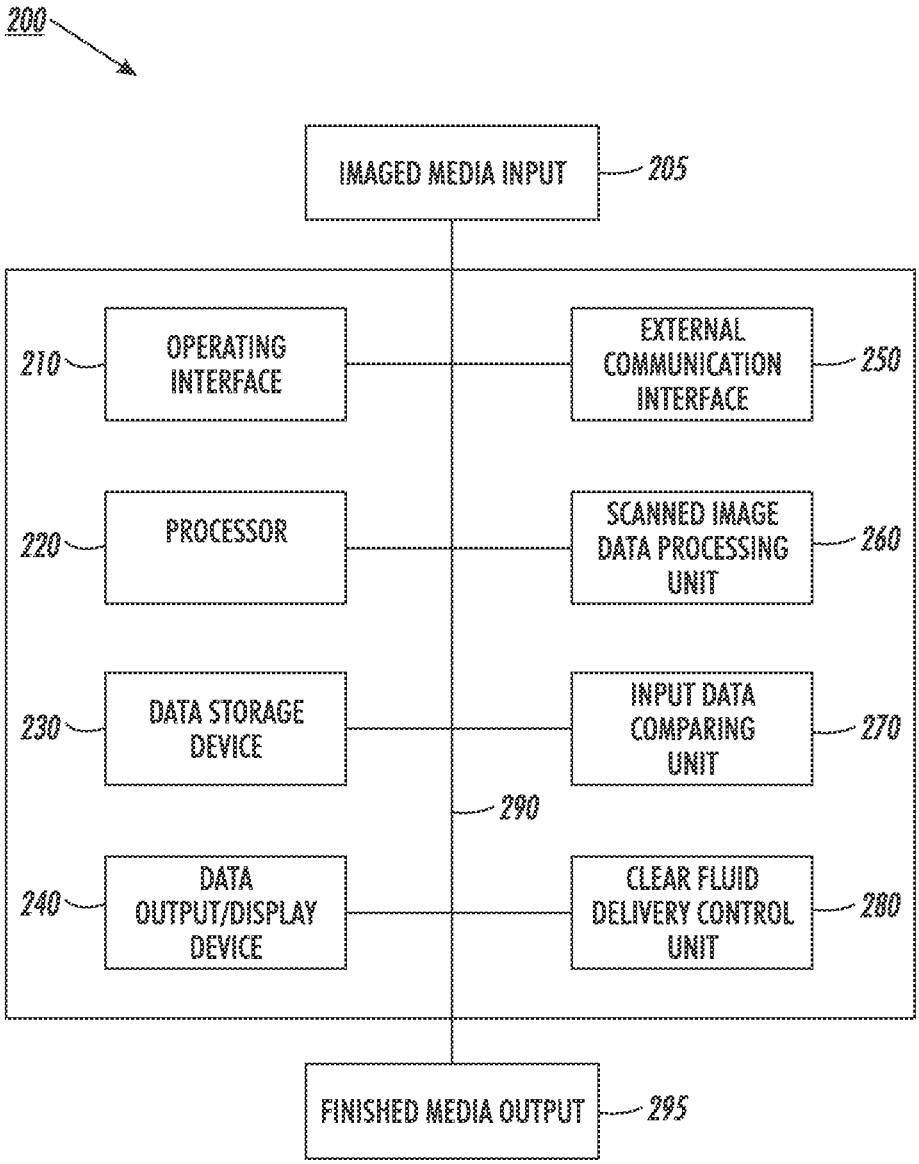
FIG. 2 illustrates a block diagram of an exemplary control system for operating a post-processor that deposits clear fluid in an image-wise manner onto one or more sides of a sheet of image receiving media to reduce an archival curl artifact according to this disclosure.

FIG. 2 illustrates a block diagram of an exemplary control system 200 for operating a post-processor module or post-processing device that is configured to deposit clear fluid in an image-wise manner onto one or more sides of sheets of image receiving media to reduce an archival curl artifact according to this disclosure. Components of the exemplary control system 200 shown in FIG. 2 may constitute components of the controller 165 shown in FIG. 1 housed in the exemplary post-processor module, or may otherwise be, for example, housed in a user workstation associated with a post-processing device and in wired or wireless communication with the post-processing device and, in embodiments, with one or more image forming devices that the post-processing device is configured or intended to support.

The exemplary control system 200 may coordinate the transport of individual sheets of image receiving media, with images formed thereon, from a physical imaged media input 205, through certain clear fluid wetting scheme implementing components and to a physical finished media output 295 in the manner generally shown in FIG. 1, and as described above.

The exemplary control system 200 may include an operating interface 210 by which a user may communicate with the exemplary control system 200, or otherwise by which the exemplary control system 200 may receive instructions input from another source. In instances where the operating interface 210 may be a locally accessible user interface, the operating interface 210 may be configured as one or more conventional mechanisms common to computing and/or image forming devices that permit a user to input information to the exemplary control system 200 to control the operations of the clear fluid wetting schemes in the post-processing device. The operating interface 210 may include, for example, a conventional keyboard and/or pointing device such as a mouse, a touchscreen with "soft" buttons or with various components for use with a compatible stylus, a microphone by which a user may provide oral commands to the exemplary control system 200 to be "translated" by a voice recognition program, or other like device by which a user may communicate specific operating instructions to the exemplary control system 200.

The exemplary control system 200 may include one or more local processors 220 for individually operating the exemplary control system 200 and for carrying out processing, scanning control, image assessment and clear fluid wetting control functions. Processor(s) 220 may include at least one conventional processor or microprocessor that interprets and executes instructions to direct these specific operations or functions in executing the clear fluid wetting schemes in a specific post-processing device with which the exemplary control system 200 may be associated.

The exemplary control system 200 may include one or more data storage devices 230. Such data storage device(s) 230 may be used to store data or operating programs to be used by the exemplary control system 200, and specifically the processor(s) 220, in carrying out the clear fluid wetting schemes and control functions of the exemplary control system 200. Data storage device(s) 230 may be used to collect and store information regarding any or all of the functions of the exemplary control system 200 to facilitate the above-described clear fluid wetting schemes. One or more of the data storage device(s) 230 may, for example, store received data regarding intended image formation on the individual sheets of image receiving media that are transported through the post-processing device for clear fluid wetting. One or more of the data storage device(s) 230 may separately store clear fluid wetting profiles for different compositions of image receiving media substrates and/or for different amounts on ink capacities found (scanned), or known, to have been deposited on the individual sheets to form the images thereon.

The data storage device(s) 230 may include a random access memory (RAM) or another type of dynamic storage device that is capable of storing collected information, and separately storing instructions for execution of system operations by, for example, processor(s) 220. Data storage device(s) 230 may also include a read-only memory (ROM), which may include a conventional ROM device or another type of static storage device that stores static information and instructions for processor(s) 220. Further, the data storage device(s) 230 may be integral to the exemplary control system 200, or may be provided external to, and in wired or wireless communication with, the exemplary control system 200, including as cloud-based storage components.

The exemplary control system 200 may include at least one data output/display device 240, which may be configured as one or more conventional mechanisms that output information to a user, including a display screen on a computing or post-processing device, including a graphical user interface (GUI) on the post-processing device. The data output/display device 240 may be usable to display to a user an indication of clear fluid wetting actions on a selection of sheets of image receiving media that may have been scanned to evaluate an area coverage and/or constitution of images formed on the sheets. The data output/display device 240 may also be usable, in conjunction with the operating interface 210, to display to a user a series of options for optimized clear fluid wetting operations in the post-processing device.

The exemplary control system 200 may include an external communication interface 250 by which the exemplary control system 200 may communicate with components external to the exemplary control system 200, including by which the exemplary control system 200 may communicate with an image forming device or an image data source to receive image forming data regarding images formed on individual sheets by the image forming device to be processed in the exemplary control system 200 for control of the clear fluid wetting schemes in the post-processing device. No particular limiting configuration to the external communication interface 250 is to be implied by the depiction in FIG. 2, other than that the external communication interface 250 may be configured to connect to external components via one or more available wired or wireless communication links.

The exemplary control system 200 may include a scanned image data processing unit 260, which may be a part or a function of processor 220 coupled to, for example, one or more data storage devices 230, or may be a separate stand-alone component module or circuit in the exemplary control system 200. The scanned image data processing unit 260 may collect and analyze scanned image data received from image scanner(s) positioned to scan images on one or both sides of the sheet of image receiving media as the sheet passes across the image scanner(s) in the post-processing device with which the exemplary control system 200 is associated. The scanned image data processing unit 260 may analyze the composition of the image data to determine where, on one or both sides of the sheet of image receiving media, clear fluid may be most advantageously applied to counteract the formation of archival curl according to the disclosed schemes.

The exemplary control system 200 may include an image data comparing unit 270, which may be a part or a function of processor 220 coupled to, for example, one or more data storage devices 230, or may be a separate stand-alone component module or circuit in the exemplary control system 200. In embodiments in which image data may be received by the exemplary control system 200 via, for example, an external communication interface 250 that communicates with one or more of an image forming device, or another image data source associated with the image forming device, the image data comparing unit 270 may compare expected image compositions with the scanned image compositions provided by the scanned image data processing unit 260. The image data comparing unit 270 may, therefore, be used to supplement the analysis undertaken by the scanned image data processing unit 260 in determining where, on one or both sides of the sheet of image receiving media, clear fluid may be most advantageously applied to counteract the formation of archival curl according to the disclosed schemes.

The exemplary control system 200 may include a clear fluid delivery control unit 280, which may be a part or a function of processor 220 coupled to, for example, one or more data storage devices 230, or may be a separate stand-alone component module or circuit in the exemplary control system 200. The clear fluid delivery control unit 280 may receive signals from the scanned image data processing unit 260, or from the processor 220, to direct specific control of clear fluid delivery components in the post-processing device with which the exemplary control system 200 is associated. The clear fluid delivery control unit 280 may direct elements of the clear fluid delivery components to provide particular placement and amounts of clear fluid image-wise on one or both sides of the sheet of image receiving media as the sheet is directed past the clear fluid delivery components in the post-processing device to counteract the formation of archival curl according to the disclosed schemes.

In embodiments that may include drying elements downstream of the clear fluid delivery component in a process direction, the clear fluid delivery control unit 280, or otherwise the processor 220, may control operation of the drying elements to dry the clear fluid deposited on the one or more sides of the sheets of image receiving media prior to those sheets exiting the post-processing device to be collected in the finished media output 295.

The flow of the individual sheets of image receiving media through the post-processing device may be generally according to the exemplary depiction in FIG. 1, and as described above. As sheets of the image receiving media with the clear fluid deposited thereon exit an outlet of the post-processing device, the sheets may be, for example, collected as finished stacks of post-processed sheets comprising a completed and stabilized print job.

All of the various components of the exemplary control system 200, as depicted in FIG. 2, may be connected by one or more data/control busses 290. These data/control busses 290 may provide wired or wireless communication between the various components of the exemplary control system 200, whether all of those components are housed integrally in, or are otherwise external and connected to, the exemplary control system 200.

It should be appreciated that, although depicted in FIG. 2 as what appears to be an integral unit, the various disclosed elements of the exemplary control system 200 may be arranged in any combination of sub-systems as individual components or combinations of components, integral to a single unit, or external to, and in wired or wireless communication with the single unit of the exemplary control system 200. In other words, no specific configuration as an integral unit or as a support unit is to be implied by the depiction in FIG. 2. Further, although depicted as individual units for ease of understanding of the details provided in this disclosure regarding the exemplary control system 200, it should be understood that the described functions of any of the individually-depicted components may be undertaken, for example, by one or more processors 220 connected to, and in communication with, one or more data storage devices 230.

Figure 3:
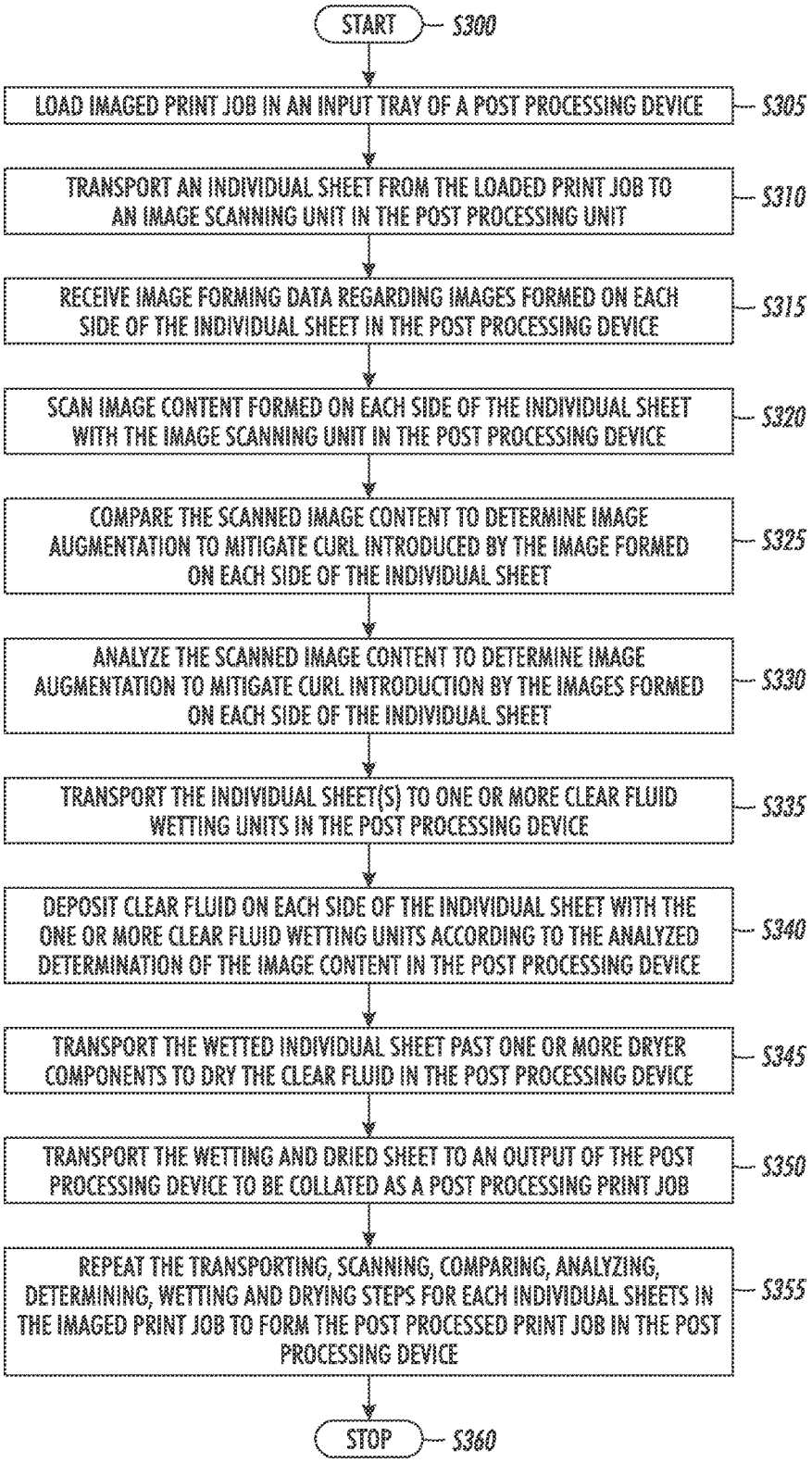
FIG. 3 illustrates a flowchart of an exemplary method for depositing clear fluid in an image-wise manner onto one or more sides of a sheet of image receiving media to reduce an archival curl artifact according to this disclosure.

The disclosed embodiments may include an exemplary method for operating an off-line particularly-configured post-processing device to deposit clear fluid in an image-wise manner according to a prescribed clear fluid wetting scheme onto one or more sides of a sheet of image receiving media to reduce an archival curl artifact. FIG. 3 illustrates a flowchart of such an exemplary method. As shown in FIG. 3, operation of the method commences at Step S300 and proceeds to Step S305.

In Step S305, one or more imaged print jobs comprising stacks of image receiving media on which images are formed separately in an image forming device employing aqueous inks as the image marking material may be loaded into an input tray of the particularly-configured post-processing device. Operation of the method proceeds to Step S310.

In Step S310, each sheet of image receiving media may be individually transported from the loaded print job(s) past an image scanning unit. The image scanning unit may scan images formed on one or both sides of each sheet of image receiving media. Operation of the method proceeds to Step S315.

In Step S315, image forming data may be separately received in the particularly-configured post-processing device from the image forming device that executed the print job. This image forming data may provide details regarding the constitution of the images formed on the one or both sides of each sheet of image receiving media. Operation of the method proceeds to Step S320.

In Step S320, the images formed on the one or both sides of each sheet of image receiving media may be scanned with the image scanning unit to determine a constitution (or composition) of those images. Operation of the method proceeds to Step S325.

In Step S325, in instances where other image forming data is available in the post-processing device, the scanned image content may be compared to the received image forming data for the images formed on the one or more sides of each sheet of image receiving media to determine the constitution of the images. Operation of the method proceeds to Step S330.

In Step S330, scanned, or scan then compared, image content data may be analyzed to determine what level of clear fluid wetting should be undertaken in the post-processing device to mitigate archival curl formation that may be introduced by the composition of the images formed on one or both sides of each sheet of image receiving media. Operation of the method proceeds to Step S335.

In Step S335, each sheet of image receiving media may be transported along a transport path in the post-processing device past one or more clear fluid wetting units. Operation of the method proceeds to Step S340.

In Step S340, clear fluid may be deposited on one or both sides of each of image receiving media by the one or more clear fluid wetting units in the post-processing device according to a clear fluid wetting scheme determined from the analysis of the scanned image content. Operation the method proceeds to Step S345.

In Step S345, each sheet of image receiving media now augmented with the deposition of clear fluid on one or more sides of the sheet may be transported past one or more dryer components to dry the clear fluid deposited on each sheet of image receiving media according to the clear fluid wetting scheme. Operation of the method proceeds to Step S350.

In Step S350, the clear fluid wetted and dried sheet of image receiving media may be transported to an output of the post-processing device to be collated as a post-processed print job. Operation of the method proceeds to Step S355.

In Step S355, the transporting, scanning, comparing, analyzing, determining, wetting and drying steps may be repeated for each of the individual sheets in the imaged print job to form the post-processed print job in the post-processing device. Operation of the method proceeds to Step S360, where operation of the method ceases.

The disclosed embodiments may include a non-transitory computer-readable medium storing instructions which, when executed by a processor, may cause the processor to execute all, or at least some, of the steps of the method outlined above.

The above-described exemplary systems and methods reference certain conventional components to provide a brief, general description of suitable print processing environments in which the subject matter of this disclosure may be implemented for familiarity and ease of understanding. Although not required, embodiments of the disclosure may be provided, at least in part, in a form of hardware circuits, firmware, or software computer-executable instructions to carry out the specific functions described. These may include individual program modules executed by a processor. Generally, program modules include routine programs, objects, components, data structures, and the like that perform particular tasks or implement particular data types in support of the overall objective of the systems and methods according to this disclosure.

Those skilled in the art will appreciate that other embodiments of the disclosed subject matter may be practiced in widely varying image forming environments with many types of image forming systems.

As indicated above, embodiments within the scope of this disclosure may also include computer-readable media having stored computer-executable instructions or data structures that can be accessed, read and executed by one or more processors. Such computer-readable media can be any available media that can be accessed by a processor, general purpose or special purpose computer. By way of example, and not limitation, such computer-readable media can comprise RAM, ROM, EEPROM, CD-ROM, flash drives, data memory cards or other analog or digital data storage device that can be used to carry or store desired program elements or steps in the form of accessible computer-executable instructions or data structures. When information is transferred or provided over a network or another communication connection, whether wired, wireless, or in some combination of the two, the receiving processor properly views the connection as a computer-readable medium. Thus, any such connection is properly termed a computer-readable medium. Combinations of the above should also be considered to be included within the scope of the computer-readable media for the purposes of this disclosure.

Computer-executable instructions include, for example, non-transitory instructions and data that can be executed and accessed respectively to cause a processor to perform certain of the above-specified functions, individually or in various combinations. Computer-executable instructions may also include program modules that are remotely stored for access and execution by a processor.

The exemplary depicted sequence of executable instructions or associated data structures represents one example of a corresponding sequence of acts for implementing the functions described in the steps. The exemplary depicted steps may be executed in any reasonable order to effect the objectives of the disclosed embodiments. No particular order to the disclosed steps of the method is necessarily implied by the depiction in FIG. 3, nor do all of the steps need to be performed, except where a particular method step is a necessary precondition to execution of any other method step.

Although the above description may contain specific details, they should not be construed as limiting the claims in any way. Other configurations of the described embodiments of the disclosed systems and methods are part of the scope of this disclosure.

It will be appreciated that various of the above-disclosed and other features and functions, or alternatives thereof, may be desirably combined into many other different systems or applications. Also, various alternatives, modifications, variations or improvements therein may be subsequently made by those skilled in the art, which are also intended to be encompassed by the following claims.

We claim:

1. A separate post-processing device for substrate wetting, comprising:

a sheet transport path that transports a sheet of image receiving media between an image receiving media input and an image receiving media output;

a scanning device positioned in the sheet transport path downstream of the image receiving media input in a process direction that scans an image formed on the sheet of image receiving media transported past the scanning device;

a wetting device positioned in the sheet transport path downstream of the scanning device in the process direction that deposits a clear fluid on the sheet of image receiving media transported past the wetting device; and a controller that is configured to receive scanned image data from the scanning device, determine at least one of an amount and a positioning of the clear fluid to be deposited image-wise on the sheet of image receiving media based on received scanned image data, and control the wetting device to deposit the clear fluid in at least one of the determined amount and the determined positioning on the sheet of image receiving media;

wherein the image receiving media input being an input tray for holding stacks of imaged sheets of image receiving media;

wherein the stacks of imaged sheets of image receiving media representing one or more print jobs separately conducted by one or more image forming devices.

2. The post-processing device of claim 1, the scanning device being a first processing component downstream from the image receiving media input in the process direction.

3. The post-processing device of claim 2, wherein the controller includes an operating interface by which a user may communicate with the controller or otherwise by which the controller may receive instruction input from another source.

4. The post-processing device of claim 3, further comprising an external data communication interface that is configured to communicate directly with the one or more image forming devices for receiving image forming data representing the one or more print jobs separately conducted by the one or more image forming devices.

5. The post-processing device of claim 4, the controller being further configured to compare the received image forming data representing the one or more print jobs separately conducted by the one or more image forming devices with the received scanned image data from the scanning device; and determine the at least one of the amount and the positioning of the clear fluid to be deposited image-wise on the sheet of image receiving media based on the comparison.

6. The post-processing device of claim 1, further comprising a data storage device storing a plurality of clear fluid wetting profiles, the controller being further configured to reference the plurality of clear fluid wetting profiles in the data storage device to determine the at least one of the amount and the positioning of the clear fluid to be deposited image-wise on the sheet of image receiving media.

7. The post-processing device of claim 1, the wetting device comprising a first wetting unit for wetting a first side of the sheet of image receiving media and a second wetting unit for wetting a second side of the sheet of image receiving media.

8. The post-processing device of claim 7, the second wetting unit being positioned in the sheet transport path downstream of the first wetting unit in the process direction, the sheet transport path being configured to manipulate the sheet in a manner that presents the first side of the sheet of image receiving media to the first wetting unit for wetting of the first side and to manipulate the sheet in a manner that presents the second side of the sheet of image receiving media to the second wetting unit for wetting of the second side.

9. The post-processing device of claim 1, further comprising a drying device positioned in the sheet transport path downstream of the wetting device in the process direction that dries the clear fluid deposited on the sheet of image receiving media transported past the drying device prior to the sheet being transported to and deposited in the image receiving media output.

10. The post-processing device of claim 1, the clear fluid being one of water only, a water and humectant mix, and an unpigmented ink vehicle.

11. A method for implementing substrate wetting in a post-processing device, comprising:

transporting a sheet of image receiving media along a sheet transport path from an image receiving media input in the post processing device;

scanning an image formed on the sheet of image receiving media transported past the scanning device;

receiving, with a control system associated with the post-processing device, scanned image data from the scanning device;

determining, with the particularly programmed processor associated with the post-processing device, at least one of an amount and a positioning of a clear fluid to be deposited image-wise on the sheet of image receiving media based on received scanned image data; and controlling, with the control system associated with the post-processing device, a wetting device that deposits the clear fluid in at least one of the determined amount and the determined positioning on the sheet of image receiving media transported past the wetting device to wet the sheet of image receiving media in a manner that inhibits the formation of archival curl in the sheet of image receiving media; and outputting the wetted sheet of image receiving media to an image receiving media output in the post-processing device;

wherein the image receiving media input being an input tray for holding stacks of imaged sheets of image receiving media;

wherein the stacks of imaged sheets of image receiving media representing one or more print jobs separately conducted by one or more image forming devices apart from the post-processing device.

12. The method of claim 11, wherein the scanning being a first processing of the sheet of image receiving media in the post-processing device.

13. The method of claim 11, wherein the control system includes an operating interface by which a user may communicate with the control system or otherwise by which the control system may receive instruction input from another source.

14. The method of claim 13, further comprising receiving, via an external data communication interface in the post-processing device, image forming data representing the one or more print jobs separately conducted by the one or more image forming devices.

15. The method of claim 14, further comprising:

comparing, with the control system associated with the post-processing device, (1) the received image forming data representing the one or more print jobs separately conducted by the one or more image forming devices with (2) the received scanned image data from the scanning device; and determining, with the control system associated with the post-processing device, the at least one of the amount and the positioning of the clear fluid to be deposited image-wise on the sheet of image receiving media based on the comparing.

16. The method of claim 11, further comprising:

storing a plurality of clear fluid wetting profiles in a data storage device associated with the post-processing device; and referencing the plurality of clear fluid wetting profiles stored in the data storage device to determine the at least one of the amount and the positioning of the clear fluid to be deposited image-wise on the sheet of image receiving media.

17. The method of claim 11, the wetting comprising wetting the first side of the sheet of image receiving media with a first wetting unit and wetting a second side of the sheet of image receiving media with a second wetting unit.

18. The method of claim 17, the second wetting unit being positioned in the sheet transport path downstream of the first wetting unit in the process direction, the method further comprising:

first manipulating the sheet of image receiving media in a manner that presents the first side of the sheet to the first wetting unit for wetting of the first side;

second manipulating the sheet of image receiving media in a manner that presents the second side to the second wetting unit for wetting of the second side.

19. The method of claim 11, further comprising drying the clear fluid deposited on the sheet of image receiving media with a drying device positioned in the sheet transport path downstream of the wetting device in the process direction prior to the sheet of image receiving media being transported to and output in the image receiving media output.

20. The method of claim 11, the clear fluid being one of water only, a water and humectant mix, and an unpigmented ink vehicle.

21. A non-transitory computer readable medium storing instructions that, when executed by a processor in a control system at a post-processing device, cause the processor to execute the steps of a method for implementing substrate wetting in the post-processing device, comprising:

scanning an image formed on the sheet of image receiving media transported past the scanning device along a sheet transport path from an image receiving media input in the post processing device;

receiving scanned image data from the scanning device;

determining at least one of an amount and a positioning of a clear fluid to be deposited image-wise on the sheet of image receiving media based on received scanned image data; and controlling a wetting device that deposits the clear fluid in at least one of the determined amount and the determined positioning on the sheet of image receiving media transported past the wetting device to wet the sheet of image receiving media in a manner that inhibits the formation of archival curl in the sheet of image receiving media prior to outputting the wetted sheet of image receiving media to an image receiving media output in the post-processing device.

* * * * *